US008104199B2

(12) United States Patent
Calderwood

(10) Patent No.: US 8,104,199 B2
(45) **Date of Patent: *Jan. 31, 2012**

(54) RIPPER BOOT INCLUDING A HIGH TENSILE TIP

(76) Inventor: James A Calderwood, Port Lincoln (AU)

( * ) Notice: Subject to any disclaimer, the term of this patent is extended or adjusted under 35 U.S.C. 154(b) by 0 days.

This patent is subject to a terminal disclaimer.

(21) Appl. No.: 12/377,371

(22) PCT Filed: Aug. 22, 2007

(86) PCT No.: PCT/AU2007/001206

§ 371 (c)(1),
(2), (4) Date: Jul. 13, 2010

(87) PCT Pub. No.: WO2008/022389

PCT Pub. Date: Feb. 28, 2008

(65) Prior Publication Data

US 2010/0269379 A1 Oct. 28, 2010

(30) Foreign Application Priority Data

Aug. 25, 2006 (AU) ..... 2006904612

(51) Int. Cl.
*A01B 13/08* (2006.01)

(52) U.S. Cl. ..... 37/453; 172/699

(58) Field of Classification Search ..... 37/446–460, 37/403–409; 172/699, 701.1, 701.3, 664, 172/719, 749, 734–739, 750–753; 299/106, 299/107; 403/361, 383

See application file for complete search history.

(56) References Cited

U.S. PATENT DOCUMENTS

| | | | | | |
|---|---|---|---|---|---|
| 2,847,921 | A * | 8/1958 | Heckathorn | 172/699 |
| 3,331,637 | A * | 7/1967 | Krekeler | 299/107 |
| 3,342,531 | A * | 9/1967 | Krekeler | 299/107 |
| 3,550,691 | A * | 12/1970 | Peterson et al. | 172/699 |
| 3,841,709 | A * | 10/1974 | Kniff | 299/101 |
| 3,932,952 | A * | 1/1976 | Helton et al. | 37/460 |
| 3,984,910 | A * | 10/1976 | Helton et al. | 419/1 |
| 4,083,605 | A * | 4/1978 | College et al. | 299/105 |
| 4,299,424 | A * | 11/1981 | LeBegue et al. | 299/103 |
| 4,488,608 | A * | 12/1984 | Berchem | 175/374 |
| 4,711,503 | A | 12/1987 | Berchem et al. | |
| 4,711,504 | A * | 12/1987 | Berchem | 299/106 |
| 4,712,321 | A * | 12/1987 | Berchem et al. | 37/453 |
| 4,736,533 | A * | 4/1988 | May et al. | 37/456 |
| 4,854,405 | A * | 8/1989 | Stroud | 175/374 |
| 5,067,262 | A * | 11/1991 | Stiffler et al. | 37/452 |
| D389,843 | S * | 1/1998 | Moreno | D15/29 |
| 6,000,153 | A * | 12/1999 | Sollami | 37/453 |
| 6,478,383 | B1 * | 11/2002 | Ojanen et al. | 299/104 |
| 7,757,778 | B2 * | 7/2010 | Calderwood | 172/699 |
| 2004/0148820 | A1 * | 8/2004 | Horton | 37/411 |

* cited by examiner

*Primary Examiner* — Robert Pezzuto
(74) *Attorney, Agent, or Firm* — Weiner & Burt, P.C.; Irving M. Weiner; Pamela S. Burt

(57) ABSTRACT

A ripper boot to cleave through hard ground. A carrier portion is connected to a shank of a vehicle. A tooth portion is integral or removably engaged with the carrier portion including a longitudinal axis and a socket at a working end. The socket extends partially into the working end including a base and one or more side walls extending forwardly of the base. The side walls extend parallel with or at a slight angle relative to the longitudinal axis. A high tensile tip includes a shaft and a conical head to extend out of the tooth portion to form a first point of contact between the tooth portion and the ground. The shaft includes a corresponding number of walls to that of the socket. The shaft of the high tensile tip is locked inside the tooth portion socket by press fitting.

9 Claims, 5 Drawing Sheets

RIPPER BOOT INCLUDING A HIGH TENSILE TIP

The present invention relates to an improved ripper boot and, in particular, to the use of a high tensile tip adapted to be press-fit into the tooth section of a ripper boot. The preferred application of the present invention is when excavating extremely hard rock which would otherwise break conventional tools.

BACKGROUND OF THE INVENTION

The present inventor is the owner of two co-pending applications relating to ripper boot improvements, namely, Australian provisional patent application no. 2005904591 and Australian complete patent application no. 2005204264. The first relates to a ripper boot having a replaceable ripping tooth. The ripping tooth includes a shank having tapered sides adapted to be press fit into a correspondingly shaped cavity in the boot so that it is fixed during operation for improved performance and reduced wear and tear. The latter application relates to a ripper boot having a replaceable ripping tooth that is angled upwardly with respect to the ripper boot carrier thereby raising the angle of attack and improving the cleaving effect. The contents of these co-pending applications are incorporated by reference herein.

As mentioned, this invention is useful in any application where extremely hard and abrasive rock is to be penetrated and ripped, for example, in the extraction of precious stones such as opal, typically achieved through use of a bulldozer ripper boot, or in heavier duty operations which require excavators and the like. In each of these circumstances, the ripper boot teeth, loader bucket teeth, etc, need to be strong and wear resistant enough to work the hard rock. Conventional ripper boots tend to break, and apply extremely high loads on machinery.

Conventional ripper boots consist of predominantly two sections, a carrier section for attachment to machinery, for example, to a bulldozer tyne or loader bucket shank, and a tooth section which is typically integrally associated with the carrier section via a weld. In the applicant's abovementioned patent applications, it is proposed that the tooth section be made replaceable. More particularly, the proposed tooth section includes a shank having tapered sides being fixable within a correspondingly shaped cavity associated with the carrier section by way of an interference fit.

The present inventor has realised an effective way of ripping through hard and abrasive ground through use of a high tensile tip. The use of hardened tips on other tools is known, whereby metals such as tungsten are welded to the tips of the tools to make use of its high strength characteristics. However, welding typically causes the temper of the metal surrounding the weld to be compromised, and as a result, it is envisaged that this would not be a suitable manufacturing method for ripper boots used in mining/excavation, as the tips would simply break off at weak spots surrounding the weld during use. When extremely hard rock is encountered, explosives are sometimes used but this is not a useful alternative because of the significant cost associated with blasting operations.

It is therefore an object of the present invention to overcome at least some of the aforementioned problems or to provide the public with a useful alternative.

It is a further object of the present invention to provide an improved ripper boot including a carrier section, an integral or replaceable tooth section, and a high tensile tip adapted to be press fit into the end of the tooth section. This does away with the need for any welds, improves the ripping ability of the tool, increases its service life, and reduces maintenance requirements.

SUMMARY OF THE INVENTION

Therefore in one form of the invention there is proposed a ripper boot characterised by:

a carrier adapted to be fixedly connected to a shank of a vehicle;

a tooth including an inwardly tapered socket at an end thereof; and a high tensile tip including a shaft and a head, said shaft being correspondingly shaped with said tooth socket for engagement therewith.

Preferably said engagement is by way of an interference fit achieved when an inner surface of the inwardly tapered socket and an outer surface of the correspondingly shaped shaft abut under pressure from the material being ripped.

In preference said carrier includes a longitudinal axis, whereby said tooth, socket and high tensile tip are disposed therealong.

Preferably said tooth end and said high tensile tip form a substantially conical shape.

Preferably the cross sectional shape of the tip shaft and tooth socket are substantially square.

Alternatively the cross sectional shape of the tip shaft and tooth socket are substantially circular.

Preferably said high tensile tip is constructed at least partially of tungsten metal.

In preference said tooth is removable from said carrier means.

In a further form of the invention there is proposed a ripper boot of the type adapted to be mounted to a bulldozer shank or like equipment, said ripper boot characterised by:

a carrier adapted to be mounted to said shank;

a tooth including at least one head portion having a female socket associated therewith; and a high tensile tip adapted to be fixedly secured within said female socket by way of an interference fit.

Preferably said high tensile tip includes a shaft portion having inwardly tapered walls adapted to engage corresponding inwardly tapered walls associated with the female socket.

In preference said high tensile tip further includes a head portion adapted to extend outwardly from said at least one head portion when the shank portion thereof is fixed within the female socket.

Preferably the inwardly tapered walls of the tip shaft portion include a binding material lining for facilitating engagement.

Preferably the inwardly tapered walls of the tooth female socket include a binding material lining for facilitating engagement.

In preference said inwardly tapered walls of the tip shaft portion and inwardly tapered walls of the tooth female socket include a binding material lining for facilitating engagement therewith.

In preference said carrier means includes a longitudinal axis, and each tooth head portion extends in substantially the same direction as the longitudinal axis.

Preferably the shape of the head portion and attached high tensile tip is substantially conical.

Preferably said high tensile tip is constructed from material having high strength characteristics such as tungsten metal.

BRIEF DESCRIPTION OF THE DRAWINGS

The accompanying drawings, which are incorporated in and constitute a part of this specification, illustrate several implementations of the invention and, together with the description, serve to explain the advantages and principles of the invention. In the drawings.

DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

Figure 1:
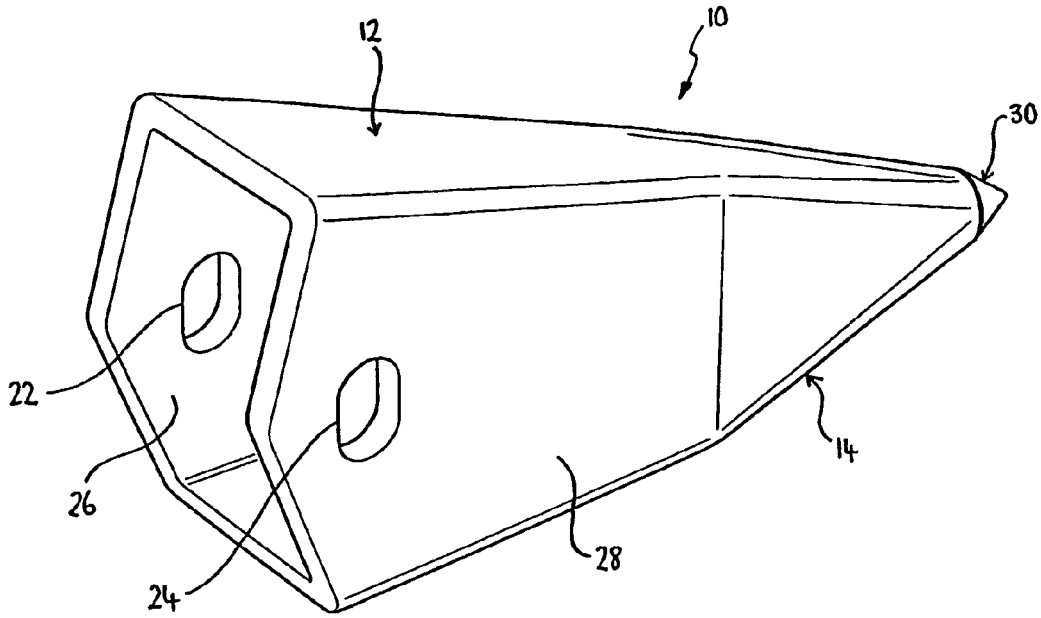
FIG. 1 illustrates a rear perspective view of an improved ripper boot in accordance with the present invention.
Figure 2:
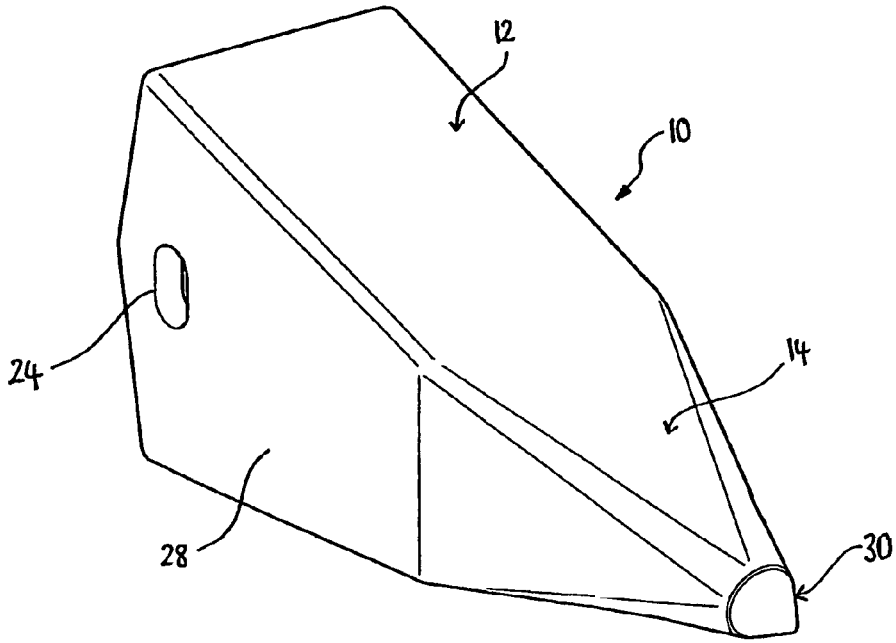
FIG. 2 illustrates a front perspective view of the improved ripper boot of FIG. 1.
Figure 3:
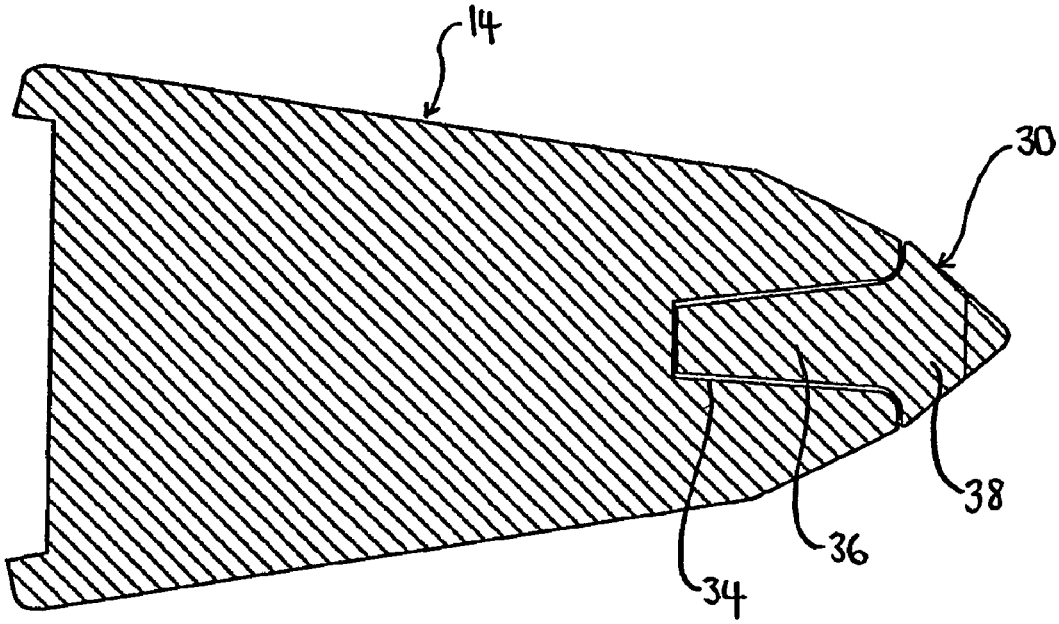
FIG. 3 illustrates an enlarged, cross-sectional side view of the tooth section forming part of the improved ripper boot of FIG. 1.
Figure 4:
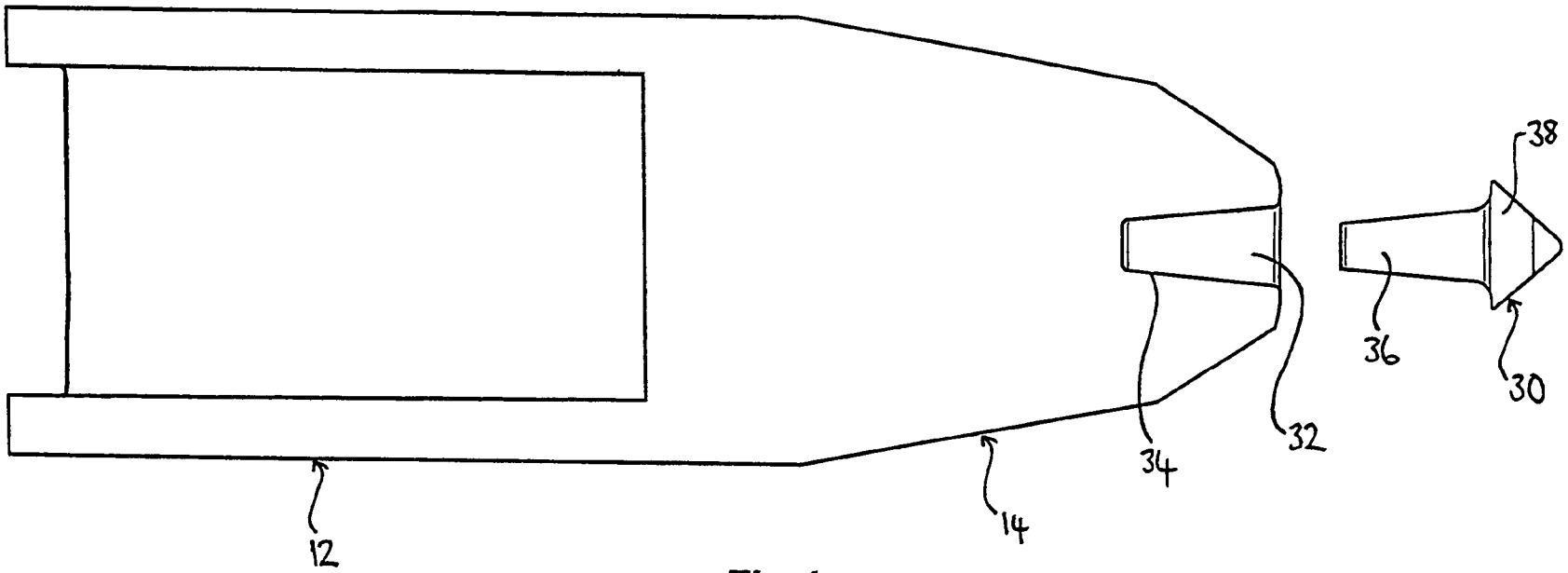
FIG. 4 illustrates an exploded, partially cross-sectional top view of the improved ripper boot of FIG. 1.
Figure 5:
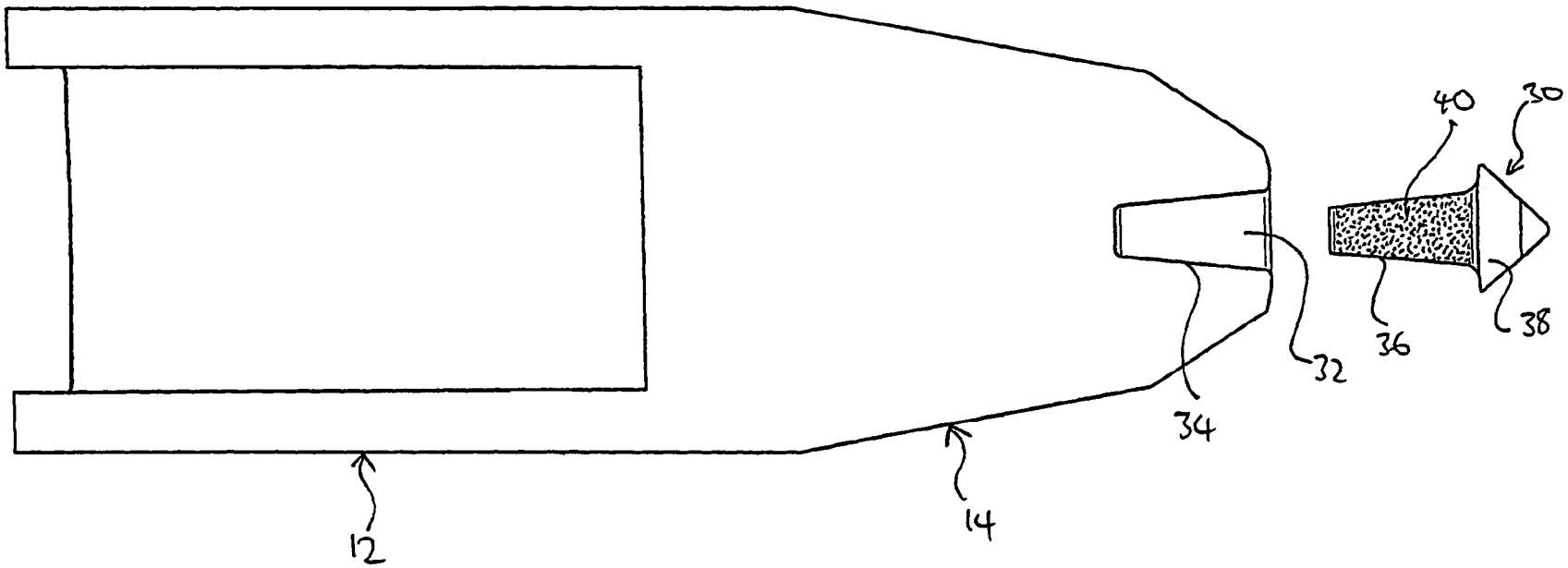
FIG. 5 illustrates an exploded, partially cross-sectional top view of the improved ripper boot of FIG. 1 including a tip having binding material lining the shank.
Figure 6:
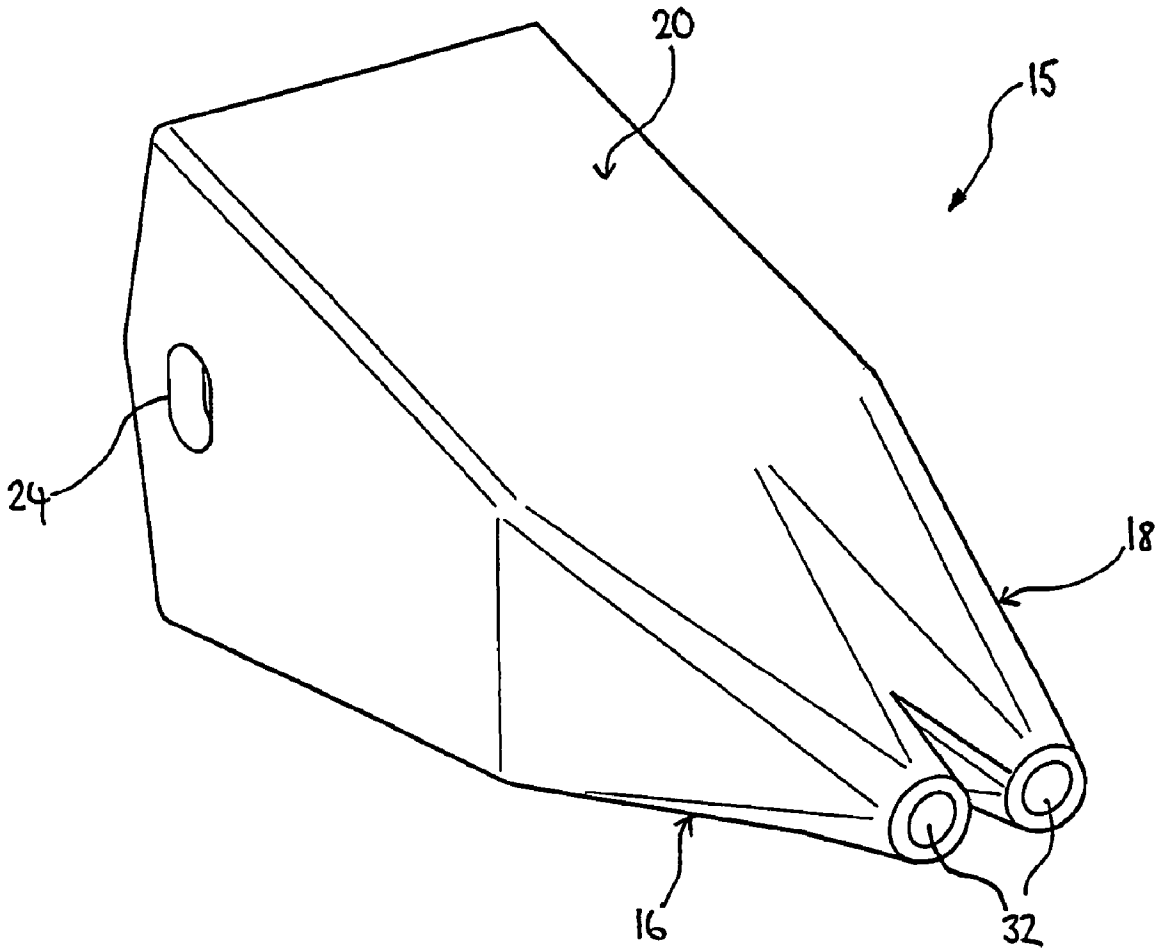
FIG. 6 illustrates a front perspective view of a ripper boot in accordance with the present invention, including a double tooth configuration for use on an excavator loader bucket.

The present invention relates to an improved ripper boot 10 as illustrated in FIGS. 1-5. The improved ripper boot 10 includes a carrier section 12, and a ripper tooth section 14 having a high tensile tip 30 adapted to be press fit into a contact end thereof. In operation, the carrier section 12 is placed over and conformed to fit over a ripper boot shank (not shown) of a bulldozer (not shown), or one or more excavator loader bucket shanks (not shown). FIG. 6 illustrates a second embodiment of the present invention where there is shown a ripper boot 15 having two tooth sections 16 and 18 associated with the one carrier section 20. It is to be understood that the present invention is not to be limited to any one application.

The carrier section 12 is typically held in place by utilisation of a pair of co-axially aligned retaining holes 22 and 24 located in opposed side walls 26 and 28 of the carrier section 12 respectively. A retaining pin (not shown) is adapted to extend through the holes 22 and 24 and through an aperture (not shown) associated with the available shank (not shown). It is to be understood that the carrier 12 may be conformed to fit any available ripper boot or loader bucket shank, and that the present invention is not intended to be limited to only this form of attachment.

As mentioned, the ripper boot includes a tooth section 14 which is integrally formed with the carrier section 12. This differs from the ripper boots of the applicant's co-pending applications in which the ripper boot tooth section is made replaceable, however, the present invention is not intended to be limited to fixed or replaceable tooth sections. In the embodiment shown, the ripper boot includes integrally formed carrier and tooth sections (typically via a weld), and a high tensile tip 30 adapted to be press-fit into the end of the ripper boot tooth section 14.

An important feature of the present invention is the way in which the high tensile tip 30 is secured to the tooth section 14. As mentioned in the preamble, it has been known to simply weld a high tensile tip to the end of certain tools to increase their strength. However, it is envisaged that the strength of the steel in the boot adjacent the weld will become compromised, and so such boots which undergo significant loads, would become prone to fracture. The present invention proposes securing the high tensile tip to the boot via an interference fit as described below.

The tooth section 14 provides a female socket or cavity 32 at an end thereof, adapted to fixedly house the high tensile tip 30. The socket 32 includes walls 34 that taper inwardly, that is, walls that define a cross-sectional shape which is greater in size adjacent the end of the tooth section 14. The shape of the cross-section is not important, what is important is the taper on the sides of the cavity which allow a shank 36 associated with the high tensile tip to be fixed therein by way of interference. Circular or square cross-sections are preferred for ease of manufacture, and it is also preferable for any sharp edges inside the socket 32 to be rounded off for additional grip.

The tip 30 itself is made up of a shank 36, as mentioned, and a head portion 38 which is essentially the tool which contacts and breaks the hard rock. The shank 36 is correspondingly shaped with the socket 32, that is, it too includes tapered walls of substantially the same cross-sectional shape. This allows the shank 36 to be fixedly secured within the female socket 32 by way of an interference fit. As those skilled in the art would realise, an interference fit is strong and ensures that no particles enter between the wall of the shank 36 and the abutting wall 34 of the socket 36. But more importantly, in press-fitting the high tensile tip 30 into the ripper tooth section 14, the strength of the surrounding steel is not compromised in any way in that there are no "weak spots" resulting from welding.

Although not necessarily needed, the surface of the shank 36 may include a thin layer of binding material 40 to aid in fixing the tip 30 within the socket 32. This is illustrated in FIG. 5. In an alternate configuration, the internal surface of the socket 32 could include the binding material. Any suitable binding material could be used, for example, it could be in the form of an epoxy (as illustrated), or ceramic braze, or a thin band of bronze. Press-fitting the tip 30 into the ripper boot socket 32 would normally be carried out in a factory prior to being sent on-site where it would then be attached to the machinery for use.

Once the high tensile tip 30 is fixed within the socket 32, the head portion 38 extends longitudinally outwardly from the tooth section 14, tapers at substantially the same angle, and terminates into a point. It is to be understood though that the shape of the tip need not necessarily be limited to this shape, for example, in some applications it is preferable for the head of the tip to be rounded, or even widened to decrease the chance of wear and subsequent failure of the boot. Also, although it is preferable that the tip be constructed of tungsten, this is by no means the only material which could be used. Any material displaying similar high strength characteristics could equally well be used.

As mentioned in the preamble, the present inventor has found that altering the angle of attack in some situations can result in a more effective cleaving effect. Thus, although not shown in any of the drawings, the tooth section 14 could be welded to the carrier section so that it extends upwardly a predetermined angle thereto. The high tensile tip 30 of the present invention could equally well be fitted into this type of ripper boot configuration.

FIG. 6 illustrates a ripper boot 15 according to a second aspect of the invention. As mentioned earlier, rather than having a single socket arrangement, there are two tooth sections 16 and 18 associated with the one carrier section 20. This therefore allows for two tips to be press-fit into the boot 15. Such a configuration may be suitable in a number of different applications including in excavator loader buckets which require a plurality of teeth for their operation. For example, a single loader bucket may include a single shank portion (not shown) for attachment thereto of a single carrier section having a plurality of associated tooth sections. As already mentioned, the present invention is not intended to be limited to any one of these configurations.

In attaching a high tensile tip 30 to a ripping tooth section 14 as described above, a number of benefits are provided. Perhaps most notably, less maintenance is required on the ripper boot during operation which means that the machinery does not need to idle so often, saving considerable time and expense. The reason for this is that the tip is preferably made of a high tensile metal such as tungsten which is less susceptible to wear and tear so it can be used for considerably longer periods before it becomes worn.

A further benefit is the quality of the ripping procedure. Hard and abrasive rock in front of the tungsten tip has been found to "explode" in its path resulting in the location of precious stones which would otherwise have been missed using conventional equipment. The fact that the tooth section and tip are both designed so that they may engage by way of an interference fit means that there are no weak spots adjacent the end of the tooth. This is the primary envisaged cause of fracture in conventional boots having welded tips.

The result is therefore a ripper boot displaying exceptional ripping ability, increased strength characteristics, increased service life, and decreased maintenance requirements.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A ripper boot adapted for use in cleaving through hard ground, said ripper boot characterised by:

a carrier portion adapted to be fixedly connected to a shank of a vehicle;

a tooth portion, being integral with the carrier portion or in removable engagement therewith, including a longitudinal axis and a socket at a working end thereof, said socket extending partially into the working end of said tooth portion and thereby including a base and one or more side walls extending forwardly of said base, said one or more side walls extending substantially parallel with or at a slight angle relative to said longitudinal axis; and a high tensile tip including a shaft and a conical head said conical head adapted to extend out of the tooth portion to form a first point of contact between the tooth portion and said hard ground, said shaft including a corresponding number of walls to that of said socket, each respective wall being correspondingly shaped; and wherein the shaft of the high tensile tip is locked inside said tooth portion socket by press fitting of the shaft inside the socket such that their respective, correspondingly shaped walls mate.

2. A ripper boot as characterised in claim 1 wherein said carrier includes a longitudinal axis which corresponds with the longitudinal axis of the tooth portion.

3. A ripper boot as characterised in claim 2 wherein said tooth portion and said high tensile tip together form a substantially conical shape.

4. A ripper boot as characterised in claim 1 wherein the cross sectional shape of the tip shaft and tooth socket are substantially square such that there are four respective mating walls.

5. A ripper boot as characterised in claim 1 wherein the cross sectional shape of the tip shaft and tooth socket are substantially circular such that there is one respective mating wall.

6. A ripper boot as characterised in claim 1 wherein said high tensile tip is constructed at least partially of tungsten metal.

7. A ripper boot as in claim 1 wherein the walls of the tip shaft include a binding material lining for facilitating engagement.

8. A ripper boot as in claim 1 wherein the walls of the tooth socket include a binding material lining for facilitating engagement.

9. A ripper boot as in claim 1 wherein said walls of the tip shaft and walls of the tooth socket include a binding material lining for facilitating engagement therewith.

* * * * *